US006321999B1

(12) United States Patent
Male et al.

(10) Patent No.: US 6,321,999 B1
(45) Date of Patent: Nov. 27, 2001

(54) FUEL INJECTOR

(75) Inventors: Andrew Male, Crawley; Anthony Thomas Harcombe, Richmond, both of (GB)

(73) Assignee: Lucas Industries plc (GB)

( * ) Notice: Subject to any disclaimer, the term of this patent is extended or adjusted under 35 U.S.C. 154(b) by 0 days.

(21) Appl. No.: 09/312,536

(22) Filed: May 14, 1999

(30) Foreign Application Priority Data

Jun. 15, 1998 (GB) ..... 9812889

(51) Int. Cl.[7] ..... F02M 41/16
(52) U.S. Cl. ..... 239/96
(58) Field of Search ..... 239/88, 89, 92, 239/93, 95, 96

(56) References Cited

U.S. PATENT DOCUMENTS 5,282,574 2/1994 Koch ..... 239/90
5,463,996 * 11/1995 Maley et al. ..... 239/88 X
5,538,187 * 7/1996 Mueller et al. ..... 239/88
5,628,293 * 5/1997 Gibson et al. ..... 239/88 X
5,673,669 * 10/1997 Maley et al. ..... 239/96 X
5,697,342 * 12/1997 Anderson et al. ..... 239/96 X
6,067,955 5/2000 Boecking ..... 123/299

FOREIGN PATENT DOCUMENTS 19512270 9/1996 (DE) .

* cited by examiner

*Primary Examiner*—Lesley D. Morris
(74) *Attorney, Agent, or Firm*—Andrus, Sceales, Starke & Sawall

(57) ABSTRACT

A fuel injector comprises a valve needle spring biased towards a seating. The valve needle defines a thrust surface orientated such that the application of fuel under pressure thereto applies a force to the needle urging the needle away from the seating. A valve is provided to control the supply of fuel to the thrust surface.

7 Claims, 2 Drawing Sheets

FUEL INJECTOR

This invention relates to a fuel injector for use in supplying fuel under pressure to a combustion space of a compression ignition internal combustion engine. In particular the invention relates to a fuel injector of the type arranged to receive fuel from an associated fuel pump, for example a pump/injector or an arrangement in which a pump and injector are connected to one another by a high pressure pipe, the pump delivering fuel exclusively to the injector.

In a known pump/injector arrangement, the timing of fuel injection is controlled by controlling the fuel pressure within a control chamber which applies a force to a valve needle of the injector, urging the needle towards a seating. The fuel pressure within the control chamber is conveniently controlled by an electromagnetically actuator valve.

The use of such a control chamber in controlling the operation of the injector requires the provision of a number of additional bores or drillings, thus increasing the complexity of the injector.

According to the present invention there is provided a fuel injector comprising a valve needle spring biased into engagement with a seating to control fuel delivery, the valve needle including a thrust surface orientated such that the application of fuel under pressure thereto applies a force to the needle urging the needle away from the seating, and a valve controlling the application of fuel under pressure to the thrust surface.

The injector conveniently further comprises a fuel pump arranged to supply fuel to the thrust surface when the valve is open. Preferably, the injector further comprises a drain valve controlling communication between a pump chamber of the fuel pump and a fuel reservoir.

Such an injector is advantageous in that the provision of a control chamber is avoided thus the injector is of relatively simple construction.

The invention will further be described, by way of example, with reference to the accompanying drawings, in which like reference numerals are used to denote like parts, and in which.

Figure 1:
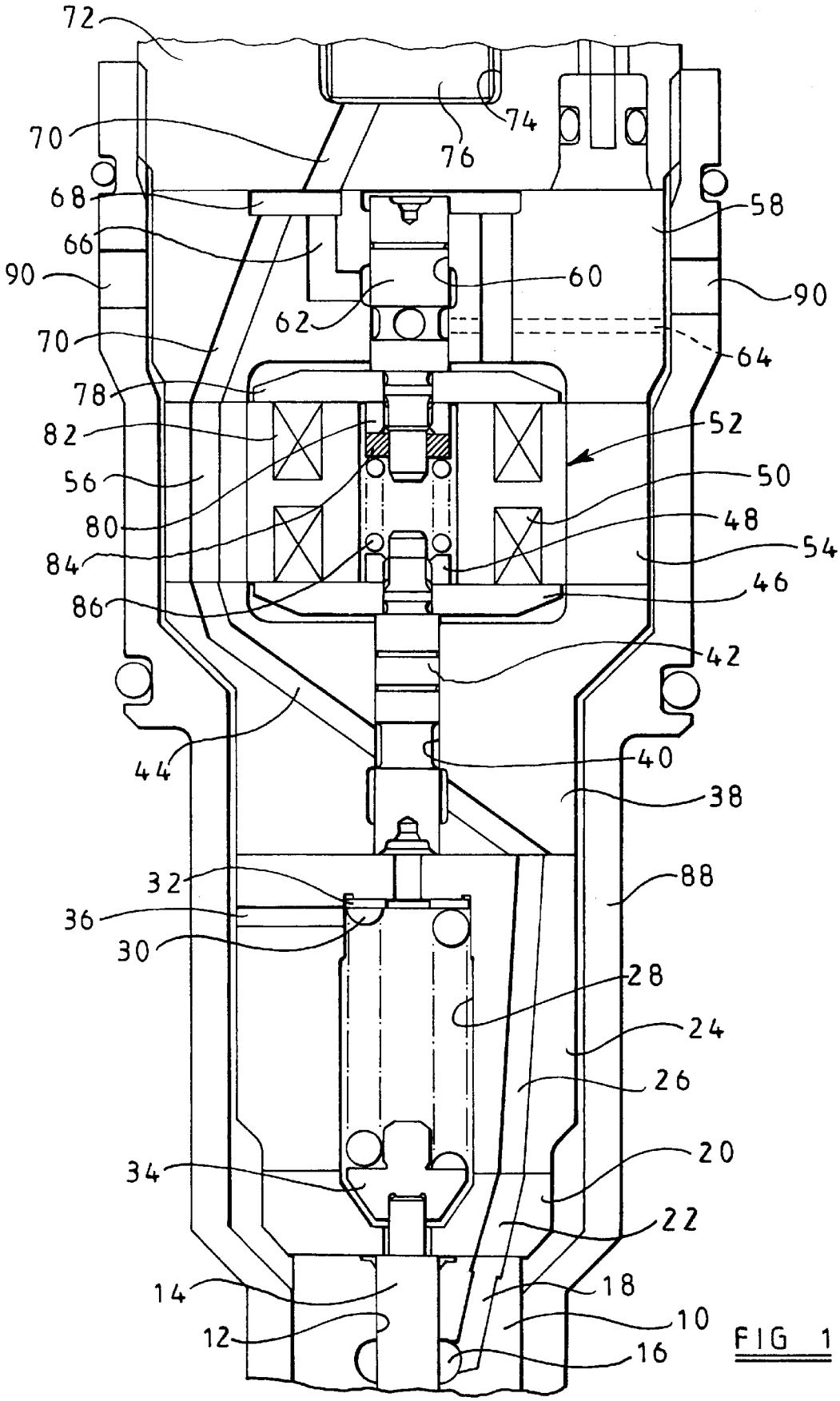
FIG. 1 is a sectional view of part of an injector in accordance with an embodiment of the invention.
Figure 3:
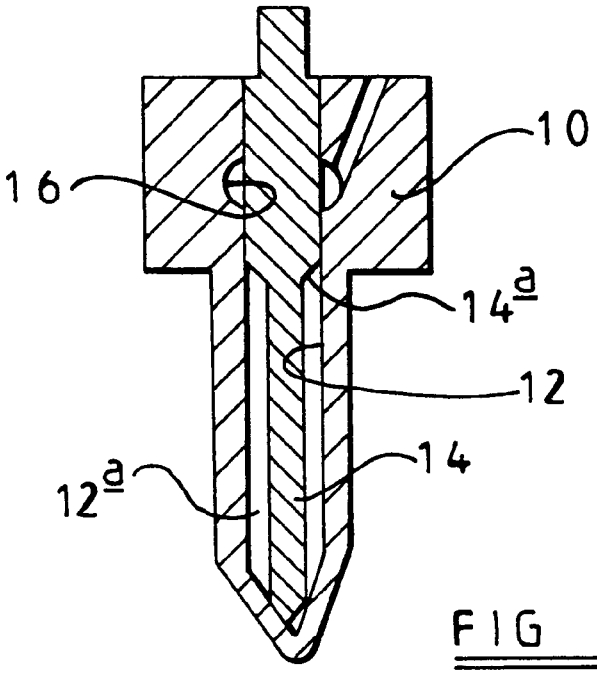
FIG. 3 is a diagrammatic view of part of the injector of FIG. 1.

The injector illustrated in FIG. 1 comprises a nozzle body 10 provided with a blind bore 12 within which a valve needle 14 is slidable. Adjacent the blind end of the bore 12, a seating is formed with which an end part of the needle 14 is engageable to control the supply of fuel from the bore 12 to one or more outlet openings located downstream of the seating. The needle 14 is shaped to include a region which is of substantially the same diameter as the adjacent part of the bore 12 to form a substantially fluid-tight seal therewith and to guide the needle for sliding movement within the bore 12. A lower part of the needle 14 is of reduced diameter and defines, with the bore 12, a chamber 12*a* (see FIG. 3) from which fuel under pressure is able to flow past the seating, in use, to be injected into a combustion space of an associated engine. At the intersection of the upper, enlarged diameter portion of the needle 14 and the lower reduced diameter portion thereof, the valve needle 14 defines a thrust surface 14*a* which is exposed to the fuel pressure within the chamber 12*a*.

The bore 12 is shaped to define an annular gallery 16. The needle 14 is shaped to include flutes whereby fuel is able to flow from the annular gallery 16 to the chamber 12*a*. The annular gallery is supplied with fuel, in use, through an inlet passage 18 provided in the nozzle body 10.

The upper surface of the nozzle body 10 abuts a first distance piece 20 which includes an axially extending through bore into which an upper end of the needle 14 extends, and a drilling 22 which communicates with the supply passage 18 of the nozzle body 10. The first distance piece 20 abuts a spring housing 24 which includes a drilling 26 communicating with the drilling 22. The spring housing 24 is further provided with a through bore including a region of relatively large diameter which defines a spring chamber 28 within which a helical compression spring 30 is located. The spring 30 engages a shim 32 located at the intersection of the spring chamber 28 with a reduced diameter portion of the through bore, the spring 30 further engaging a spring abutment member 34 which is carried by the upper end of the needle 14. The spring 30 acts to bias the valve needle 14 into engagement with the seating. The spring chamber 28 communicates through a passage 36 with a low pressure drain reservoir.

The upper surface of the spring housing 24 engages a control valve housing 38 including a through bore 40 within which a control valve member 42 is slidable. The through bore 40 defines a seating with which an enlarged diameter portion of the valve member 42 is engageable to control the flow of fuel along a drilling 44 which extends from the upper surface of the control valve housing 38 to a portion of the lower surface of the valve housing 38 which communicates with the drilling 26. The upper part of the control valve member 42 is of diameter substantially equal to that of the adjacent part of the bore 40 to form a substantially fluid-tight seal therewith. The lower part of the control valve member 42 also forms a good seal with the bore 40, but as it is difficult to manufacture bores including regions of different diameter, the regions being concentric with one another, a small amount of leakage is likely between the lower part of the valve member 42 and the adjacent part of the bore 40. Fuel escaping between the valve member 42 and the lower part of the bore 40 flows to the spring chamber 28 through the upper, small diameter part of the through bore of the spring housing 24. In order to minimise the quantity of fuel flowing in this manner, when the control valve member 42 occupies a position in which the enlarged part thereof is spaced from its seating, the lower end of the control valve member 42 is arranged to engage, and form a substantially fluid-tight seal with the upper surface of the spring housing 24.

The upper end of the control valve member 42 carries an armature 46, the armature 46 being secured to the control valve member 42 by means of an internally screw-threaded member 48. The armature 46 is moveable under the influence of a magnetic field generated, in use, by a first winding 50 of an actuator 52 located within an actuator housing 54 which abuts the upper surface of the control valve housing 38. The actuator housing 54 includes a drilling 56 which communicates with the upper part of the drilling 44.

The upper surface of the actuator housing 54 abuts a drain valve housing 58 which includes a through bore 60 within which a drain valve member 62 is slidable. The drain valve member 62 includes a region of enlarged diameter which is engageable with a seating to control the flow of fuel between a passage 64 which communicates with the drain reservoir and a passage 66 which communicates with a recess 68 formed in the upper surface of the drain valve housing 58.

The recess 68 further communicates with a drilling 70 formed in a pump housing 72 which abuts the upper surface of the drain valve housing 58. The pump housing 72 includes a plunger bore 74 within which a plunger 76 is reciprocable under the influence of a conventional cam and tappet arrangement (not shown).

The lower end of the drain valve member 62 carries an armature 78, the armature 78 being secured to the drain valve member 62 by means of an internally screw-threaded member 80. The armature 78 is moveable under the influence of a magnetic field generated, in use, by a second winding 82 forming part of the actuator 52. The drain valve member 62 further carries a shim 84, a spring 86 being located between the shim 84 and the member 48. The spring 86 acts to bias the drain valve member 82 away from its seating and to bias the control valve member 42 away from its seating.

The various housings forming part of the injector are secured to the pump housing 72 by means of a cap nut 88 which engages a shoulder defined by the nozzle body 10, the cap nut 88 being in screw-threaded engagement with external screw-thread formations formed on the pump housing 72. The cap nut 88 and various housing parts of the injector together define a chamber with which the passage 36 and the passage 64 communicate, the chamber communicating with the low pressure reservoir through passages 90 formed in the cap nut 88.

In use, with the plunger 76 occupying its innermost position and with the first and second windings 50, 82 of the actuator 52 de-energized, the drain valve member 62 and control valve member 42 both occupy positions in which they are spaced from their respective seatings. Retraction of the plunger 76 under the action of a return spring (not shown) draws fuel from the low pressure fuel reservoir past the drain valve member 62 to charge the plunger bore 74 with fuel under relatively low pressure. Fuel continues to flow into the injector until the plunger 76 occupies its outermost position. Once the plunger 76 occupies its outermost position, subsequent inward movement of the plunger 76 displaces fuel back past the drain valve member 62 to the low pressure fuel reservoir.

When it is determined that pressurization of fuel should commence, the first and second windings 50, 82 of the actuator 52 are energized resulting in movement of the control valve member 42 into engagement with its seating, and movement of the drain valve member 62 into engagement with its seating. As a result of the engagement of the drain valve member 62 with its seating, continued inward movement of the plunger 76 no longer displaces fuel to the lower pressure fuel reservoir, and instead the fuel present in the plunger bore 74 and in the passages in communication therewith is pressurised.

When the control valve is closed, the valve member 42 thereof is substantially pressure balanced so the increase in fuel pressure does not result in movement of the control valve member 42 or in commencement of injection.

When it is determined that injection should commence, the first winding 50 of the actuator 52 is de-energized thus permitting movement of the control valve member 42 away from the seating under the action of the spring 86. The dimensions of the control valve member 42 are such that once movement of the valve member 42 away from its seating has commenced, the control valve member is no longer pressure balanced, and the fuel pressure acting upon the control valve member 42 applies a force assisting the spring 86 in moving the control valve member 42 in a downward direction. The movement of the control valve member 42 permits fuel under pressure to be supplied to the bore 12 of the nozzle body 10, thus increasing the fuel pressure acting upon the thrust surfaces of the needle, and a point will be reached beyond which the fuel pressure acting upon the needle 14 is sufficient to cause movement of the needle 14 away from its seating against the action of the spring 30. Once such movement has occurred, injection takes place.

During injection, a small amount of leakage of fuel between the control valve member 42 and bore 40 may occur, but this flow of fuel is limited by the seating of the lower end of the valve member 42 against the upper surface of the spring housing 24.

In order to terminate injection, the second winding 82 of the actuator 52 is de-energized, and the drain valve member 62 moves under the influence of the spring 86 to lift the drain valve member 62 away from its seating, thus re-establishing communication between the plunger bore 74 and the low pressure drain reservoir. The fuel pressure within the plunger bore 74 and passages in communication therewith rapidly reduces, thus the fuel pressure acting upon the thrust surfaces 14*a* of the needle 14 rapidly falls, and the valve needle 14 moves under the action of the spring 30 into engagement with its seating, thus terminating the flow of fuel to the outlet apertures of the nozzle body 10. After termination of injection, continued inward movement of the plunger 76 continues to displace fuel to the low pressure fuel reservoir until the plunger 76 reaches its innermost position. Once this position has been reached, the plunger 76 commences outward movement as described hereinbefore.

It will be appreciated that the use of the control valve and drain valve to control commencement of pressurization, commencement of injection and termination of injection permits accurate control of the injector. It will further be appreciated that as the provision of a control chamber is avoided, the injector is of relatively simple construction.

Figure 2:
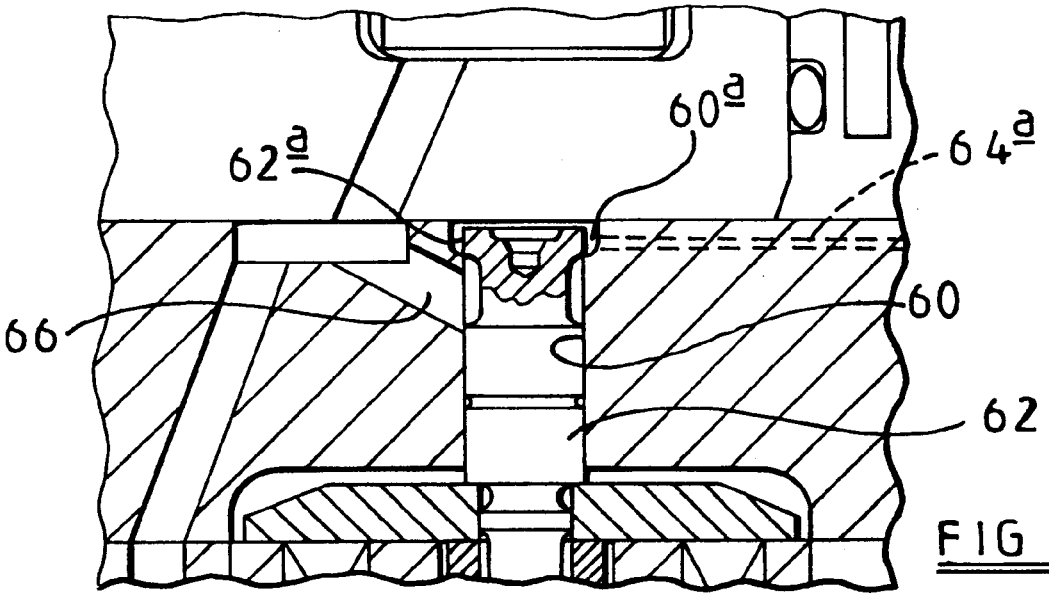
FIG. 2 is a sectional view illustrating a modification to the injector of FIG. 1.

FIG. 2 illustrates a modification to the arrangement of FIG. 1. In the modification of FIG. 2, the drain valve member 62 includes an enlarged diameter end region 62*a* which is engageable with a seating defined by the bore 60 to control fuel flow between the passage 66 and a chamber 60*a* defined by part of the bore 60. The chamber 60*a* communicates through a passage 64*a* with a low pressure fuel reservoir. As the chamber 60*a* is at low pressure, the provision of additional passages in the drain valve housing to avoid the formation of a hydraulic lock preventing movement of the valve member 62 can be avoided.

Operation of the modification illustrated in FIG. 2 is as described with reference to FIG. 1.

Although the description hereinbefore is of a pump injector, it will be appreciated that the invention is also applicable to an arrangement in which the pump is located in a position remote from the injector, and is connected thereto by means of a high pressure pipe, the fuel pump supplying fuel exclusively to the injector.

In the description hereinbefore, the first winding 50 is energized at the same time as energization of the second winding 82. It will be appreciated, however that the first winding 50 may be energized to close the control valve 42 at a stage in the operating cycle of the injector earlier than that described hereinbefore. For example, the control valve member 42 may be moved into engagement with its seating whilst the plunger 76 is being withdrawn from the plunger bore 74, rather than awaiting commencement of pressurization.

We claim:

1. A fuel injector comprising a valve needle spring biased into engagement with a seating to control fuel delivery, the valve needle including a thrust surface orientated such that the application of fuel under pressure thereto applies a force to the needle urging the needle away from the seating, and a valve, comprising a valve member, for controlling the supply of fuel under pressure to the thrust surface, the valve member including an enlarged diameter region which is engageable with a further seating to control fuel flow along a first passage, wherein the enlarged diameter region includes an end face adapted for engagement with a surface to close a second passage when the enlarged diameter region of the valve member is spaced from its seating.

2. A fuel injector as claimed in claim 1, wherein the valve is electromagnetically controlled.

3. A fuel injector as claimed in claim 1, further comprising a fuel pump arranged to supply fuel under pressure to the thrust surface when the valve is open.

4. A fuel injector as claimed in claim 3, further comprising a drain valve controlling communication between a pump chamber of the pump and a fuel reservoir.

5. The fuel injector as claimed in claim 1, wherein the valve is housed within a valve housing having an upper surface and a lower surface, the first passage extending from the upper surface of the valve housing to the lower surface of the valve housing to permit fuel to be supplied to the thrust surface of the valve needle when the valve member is moved away from the further seating.

6. The fuel injector as claimed in claim 3, wherein the valve member is movable within a bore, the second passage being defined between the valve member and the bore.

7. The fuel injector as claimed in claim 6, wherein the end of the valve needle is adapted for engagement with a surface of a further housing defining a chamber for housing a compression spring which serves to urge the valve needle into engagement with the seating.

* * * * *

UNITED STATES PATENT AND TRADEMARK OFFICE

CERTIFICATE OF CORRECTION

PATENT NO. : 6,321,999 B1
APPLICATION NO. : 09/312536
DATED : November 27, 2001
INVENTOR(S) : Andrew Male et al.

It is certified that error appears in the above-identified patent and that said Letters Patent is hereby corrected as shown below:

Column 6, claim 6, line 8, delete "3" and substitute therefore --1--.

Signed and Sealed this

Seventeenth Day of July, 2007

JON W. DUDAS
*Director of the United States Patent and Trademark Office*